US005277295A

United States Patent [19]

Grecksch et al.

[11] Patent Number: 5,277,295

[45] Date of Patent: Jan. 11, 1994

[54] TEXTILE ARTICLE REMOVAL APPARATUS FOR REMOVING TEXTILE ARTICLES FROM SUPPORTED DISPOSITIONS ON THE POSTS OF SUPPORT MEMBERS

[75] Inventors: Hans Grecksch; Heinz Buhren, both of Monchengladbach; Dieter Vits, Neuss; Manfred Hauers, Viersen, all of Fed. Rep. of Germany

[73] Assignee: W. Schlafhorst AG & Co., Moenchengladbach, Fed. Rep. of Germany

[21] Appl. No.: 803,327

[22] Filed: Dec. 4, 1991

[30] Foreign Application Priority Data

Dec. 4, 1990 [DE] Fed. Rep. of Germany ..... 4038628

[51] Int. Cl.[5] ..... B65G 47/26

[52] U.S. Cl. ..... 198/457; 198/465.1; 198/487.1; 198/598; 198/626.6; 414/416; 242/35.5 A

[58] Field of Search ..... 198/457, 487.1, 598, 198/604, 624, 626.6, 803.12, 465.1; 414/416, 417; 209/617, 618, 927; 242/35.5 A

[56] References Cited

U.S. PATENT DOCUMENTS

| | | | |
|---|---|---|---|
| 2,233,555 | 3/1941 | Reisinger | 198/803.12 |
| 2,503,803 | 4/1950 | Cremer et al. | 198/604 |
| 3,910,430 | 10/1975 | Sokolow | 198/598 |
| 4,674,636 | 6/1987 | Sekitani et al. . | |
| 4,753,336 | 6/1988 | Taylor et al. | 198/487.1 |
| 5,074,401 | 12/1991 | Morita et al. | 198/803.12 |

FOREIGN PATENT DOCUMENTS

| | | |
|---|---|---|
| 46-4515 | 2/1971 | Japan . |
| 49-26531 | 3/1974 | Japan : |

*Primary Examiner*—Joseph E. Valenza
*Attorney, Agent, or Firm*—Shefte, Pinckney & Sawyer

[57] ABSTRACT

An apparatus removes textile articles such as empty tubes or full yarn packages from the individual posts on which such articles are supported simultaneous with advancing movement of the posts. The textile articles are removed in a direction generally parallel to the axis of the posts so that during removal detrimental binding of the textile article relative to the post does not occur. According to one aspect of the invention, at least one pair of endless belts are mounted in spaced, parallel relation to one another to form an elongate opening therebetween. The elongate opening is aligned with the travel path of the textile articles being advanced on the posts so that the textile articles automatically enter the elongate opening and are engaged by the endless belts without the need to stop or otherwise control the advancing movement of the textile articles. In another aspect of the invention, a pair of spaced, parallel elongate rollers are provided, the elongate rollers being rotated in opposite directions to effect removal of a textile article which has been advanced into the elongate opening formed between the rollers. The textile article removal apparatus preferably also includes a collection assembly for collecting removed textile articles in an orderly manner and an assembly for transporting loads of removed textile articles to a location for further handling.

13 Claims, 6 Drawing Sheets

TEXTILE ARTICLE REMOVAL APPARATUS FOR REMOVING TEXTILE ARTICLES FROM SUPPORTED DISPOSITIONS ON THE POSTS OF SUPPORT MEMBERS

BACKGROUND OF THE INVENTION

The present invention relates to an apparatus for removing textile articles from supported dispositions on the posts of support members, the textile articles being tubes or tubes having textile strand material built thereon.

Tubes of the type on which textile strand material is built typically have an elongate shape and a hollow interior. Numerous transport systems have been proposed for transporting such tubes with the tubes either in an empty status (no textile strand material thereon) or in a condition in which textile strand material has been built on the tube and several of these transport systems include support members each for individually supporting a tube in a separate disposition from the other tubes. The support members may be interconnected to one another for simultaneous advancing movement of the support members and one example of this type of transport system arrangement is a plurality of textile article support members mounted to a flexible endless member at uniform spacings therealong. Another transport system arrangement includes independently movable support members, each capable of individually supporting a tube in an upright disposition thereon, and a device for advancing the independent support members along a travel path. Both in those transport system arrangements in which the support members are interconnected together and those transport systems in which the support members are independently movable, the support members each include a cylindrical post having a diameter selected in relation to the inside diameter of the hollow interior of a tube for snug receipt of a tube inserted over the post of a support member.

At various stages during the processing of a textile article, the textile article, which may be an empty tube or a tube having textile strand material built thereon, must be removed from the support member on which it is supported and this textile article removal process necessarily includes axially moving the textile article along and beyond the post on which it is supported. Various textile article removal devices have been proposed. For example, in Japanese Patent Document 49-26531, a textile article removal device is disclosed for removing textile articles supported in upright dispositions on posts uniformly mounted along the extent of an endless belt. In this known textile article removal device, a pair of oppositely moving endless belts are disposed adjacent the travel path of the textile articles and the pair of oppositely moving endless belts form an opening therebetween.

As each supported textile article is advanced along the travel path to a position adjacent the opening, the post on which the textile article is supported is displaced in a direction transverse to the travel path to thereby effect movement of the supported textile article into the opening until the textile article is frictionally engaged at generally diametrically opposite locations by the pair of oppositely moving endless belts of the textile article removal device. The oppositely moving endless belts then draw the engaged textile article off the post on which it is supported with the advancing movement of the post being temporarily halted during the drawing off of the textile article. Following removal of the textile article from the post, the advancing movement of the other textile articles continues while the removed textile article is transported by the oppositely moving endless belts of the textile article removal device to a chute along which the textile article slides to a collection container.

U.S. Pat. No. 4,674,636 to Sekitani et al discloses a textile article removing device operable to remove textile articles from support members of the type which are movable independently of one another. In this known textile article removal device, the individual support member on which each textile article is supported is temporarily stopped at a removal location and a pair of opposed engaging surfaces such as, for example, an endless belt and a roller, are moved toward one another to frictionally engage a supported textile article therebetween. Once frictionally engaged between the opposed engaging surfaces, the textile article is drawn off from its associated support member and the now-empty support member is subsequently advanced beyond the removal location.

In both of the known textile article removing devices just described, the advancing movement of the textile articles must be temporarily halted each time a support member is advanced into the removal location so that the respective textile article at the removal location can be frictionally engaged and drawn off of its associated support member. The start of a textile article removal operation must therefore be coordinated with the advancing movement of the textile articles in cycles of stopping and re-starting the advancing movement of the textile articles. This correspondingly limits the rate at which textile articles can be removed from their associated support members. Accordingly, the need still exists for improvements in the expeditious removal of textile articles from support members and particularly in minimizing interruptions in the advancing movement of textile articles during the removal operation.

SUMMARY OF THE INVENTION

The present invention provides a textile article removing apparatus which advantageously removes textile articles from support members at a relatively high rate without any significant interruption in the advancing movement of the textile articles. Briefly described, the present invention provides an apparatus for removing textile articles from supported dispositions on support members, each textile article being a tube or a tube having textile strand material built thereon and each support member having a post for supporting a tube inserted thereon in co-axial relation thereto. The apparatus includes means for advancing the support members and the textile articles supported thereon along a travel path and means for displacing a textile article in a direction generally parallel to the axis of the post on which it is supported as the support member advances along the travel path to thereby effect removal of the textile article from the post readily without inclination of the textile article relative to the post during the removal of the textile article sufficient to resist removal.

The displacing means includes a pair of opposed article engaging surfaces forming an elongate opening therebetween and means for supporting the opposed engaging surfaces with the elongate opening aligned with a portion of the travel path for entry of textile articles into the elongate opening during advancing movement of the support members along the travel path. The pair of opposed article engaging surfaces engage each textile article advancing along the travel path and displacing it from its associated post as the post is advanced along the aligned portion of the travel path.

According to one feature of the present invention, the apparatus also includes means for mounting at least one of the pair of article opposed engaging surfaces for resilient movement thereof in a direction transverse to the longitudinal extent of the elongate opening, the at least one opposed engaging surface and the other opposed engaging surface forming the elongate opening with a width extent transverse to the travel path slightly less than the corresponding width of the textile article which enters the elongate opening. The mounting means is operable via the at least one opposed engaging surface yieldably inwardly toward the other surface for compressive engagement of a textile article therebetween.

According to another feature of the present invention, the lateral spacing between the opposed article engaging surfaces at upstream ends relative to the direction of advancement of the support members is greater than the width of the articles for facilitating entry of textile articles into the elongate opening. According to a further feature of the present invention, the pair of opposed engaging surfaces form the elongate opening with a longitudinal extent greater than at least two times the corresponding width of a textile article.

According to one aspect of the present invention, each support member is independently movable and the means for advancing the support members includes an endless member and a plurality of engagement components mounted thereto, each engagement component individually engaging a support member for transport of the support member by the endless member. Additionally, the displacing means includes means for mounting the pair of opposed article engaging surfaces to form the elongate opening in the plane of travel of the articles along the travel path and at an inclination to the travel path, and the endless member and the engagement components support the support members relative to the endless member such that the textile articles extend generally perpendicular to the path of travel of the endless member, the pair of opposed article engaging surfaces moving a textile article engaged therebetween in a direction inclined to the travel path of the endless member during removal of the textile article from the post.

According to one variation of the present invention, the displacing means includes a first endless member assembly forming one of the opposed engaging surfaces and a second endless member assembly forming the other opposed engaging surface, the first and second endless member assemblies each including an endless member and means for supporting the endless member for travel in a travel path, and at least one of the first and second endless member assemblies including means for driving its respective endless member. In the one variation, the displacing means preferably includes means for synchronously driving the endless members of the first and second endless member assemblies during compressive engagement of a textile article therebetween to effect movement of the textile article in a direction generally parallel to the axis of the post on which it is supported during movement of the post along the travel path.

According to a different aspect of the present invention, the displacing means includes a first elongate roller forming one of the opposed engaging surfaces and a second elongate roller forming the other opposed engaging surfaces, means for mounting the elongate rollers with their axes parallel to the direction of advancement of the support members along the aligned portion of the travel path for entry of textile articles into the elongate opening formed between the elongate rollers during advancing movement of the support members along the travel path, and means for rotating at least one of the elongate rollers about its axis in a direction causing removal of an article from the post on which it is supported. Preferably, the upstream end of each elongate roller relative to the direction of the advancement of the textile articles is tapered to form an enlarged opening for the entry of textile articles into the elongate opening.

According to a further aspect of the present invention, the means for advancing the support members includes means for advancing the support members with their post axes in a horizontal plane and the apparatus further includes an assembly for arranging the removed textile articles in a predetermined arrangement following their removal from the posts of the support members. The assembly for arranging the removed textile articles in a predetermined arrangement preferably includes means forming a first retaining area for retaining a predetermined number of textile articles in a predetermined arrangement therein and means forming a second retaining area for retaining a predetermined number of textile articles therein in a predetermined arrangement, the second retaining area having a capacity to retain at least twice as many textile articles as the first retaining area, and the means forming the second retaining area being mounted relative to the means forming the first retaining area for receiving therefrom loads of textile articles. Also, the displacing means is preferably operable to translationally move each textile article in an orientation in which the axis of the tube of the textile article remains parallel to the post on which the textile article was supported after removal of the textile article from the post and the assembly for arranging removed textile articles in a predetermined arrangement includes means for selectively engaging a removed textile article to effect tumbling of the article in end-to-end manner.

According to further features of the further aspect of the present invention, each textile article is of a larger cross-sectional area at one end than at its other end and the means for selectively engaging a textile article to effect tumbling thereof is operable to effect tumbling of every other textile article removed by the textile article removing apparatus, whereby the removed textile articles can be arranged in end alternating manner by the assembly for arranging removed textile articles in a predetermined arrangement. According to yet other features of the further aspect of the present invention, the means forming the second retaining area is disposed below the first retaining area for receiving loads of textile articles transferred therefrom and the apparatus also includes means for disposing a container in a loading disposition in which the means forming the first retaining area and the means forming the second retaining area project interiorly of the container.

According to yet another aspect of the present invention, the means for advancing the support members includes means for vertically transporting the support members from a transfer location, means for transporting the support members in a generally horizontal direction at a vertical level above the transfer location, and means for vertically transporting the support members from the generally horizontal travel path to a second transfer location at a lower level than the generally horizontal travel path.

According to yet additional features of the further aspect of the present invention, the means for disposing a container for receipt of textile articles from the means forming first and second retaining areas includes means for lowering the container in correspondence with the loading of textile articles thereinto, the lowering means lowering a container after receipt therein of an initial load of textile articles dropped from the means forming the second retaining area at a spacing from the bottom of the container to a position in which the means forming the second retaining area is spaced further from the bottom of the container for facilitating the smooth transfer of textile articles from the means forming a second retaining area into the container. Also, the assembly for arranging removed textile articles in a predetermined arrangement preferably includes a pair of spaced, generally parallel wall members centrally interconnected at their lower ends by a sloped channeling member, the sloped channeling member cooperating with the means forming a second retaining area to guide textile articles being transferred from the second retaining area into a container. Also, the apparatus preferably includes a container transport assembly for transporting containers into and out of a lowered position from which a container is raised into a loading position in which the means forming a second retaining area projects interiorly of the container.

Figures 3, 3A, 3B:
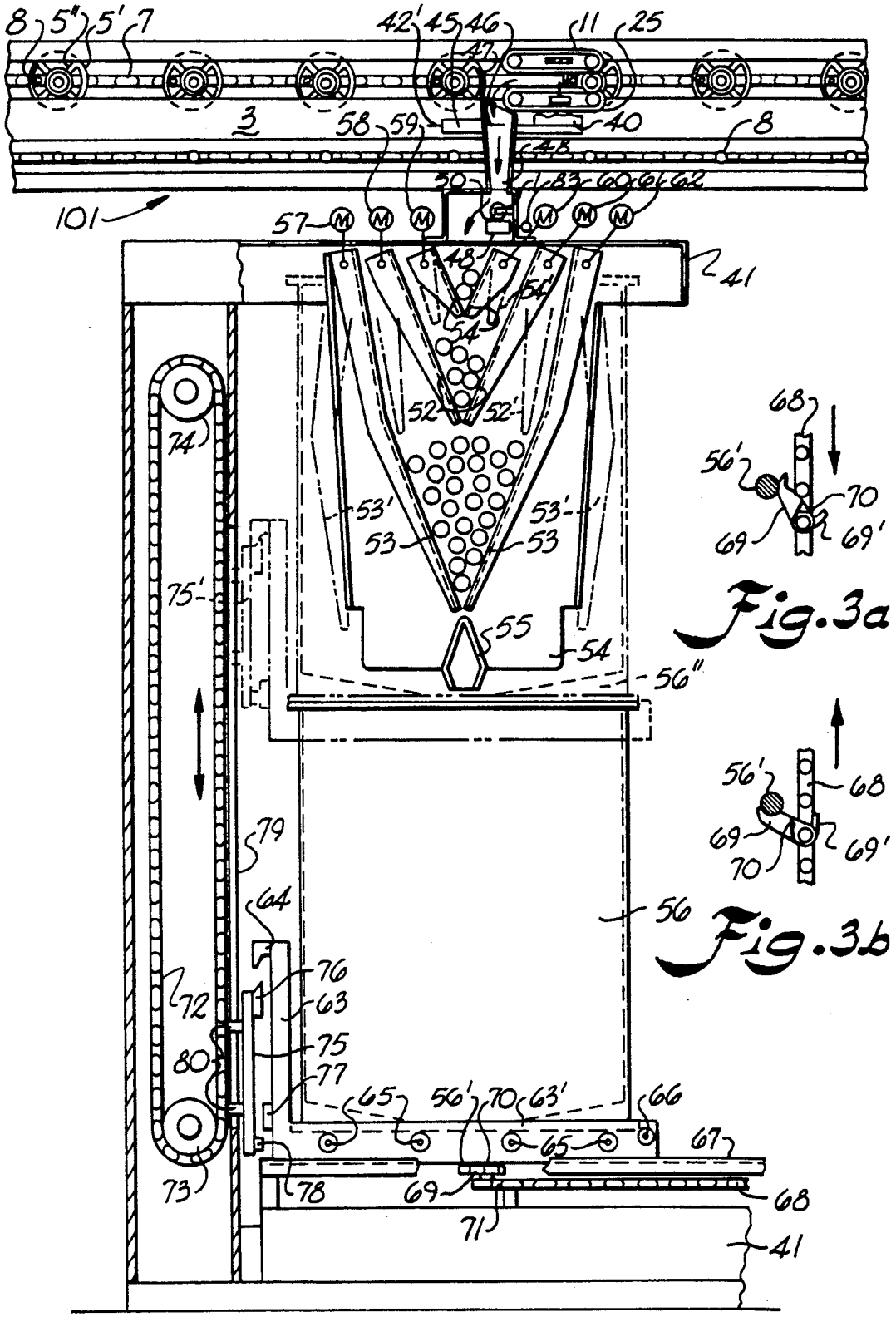
FIG. 3 is a front elevational view of the textile article removing apparatus of the present invention.
Figure 4:
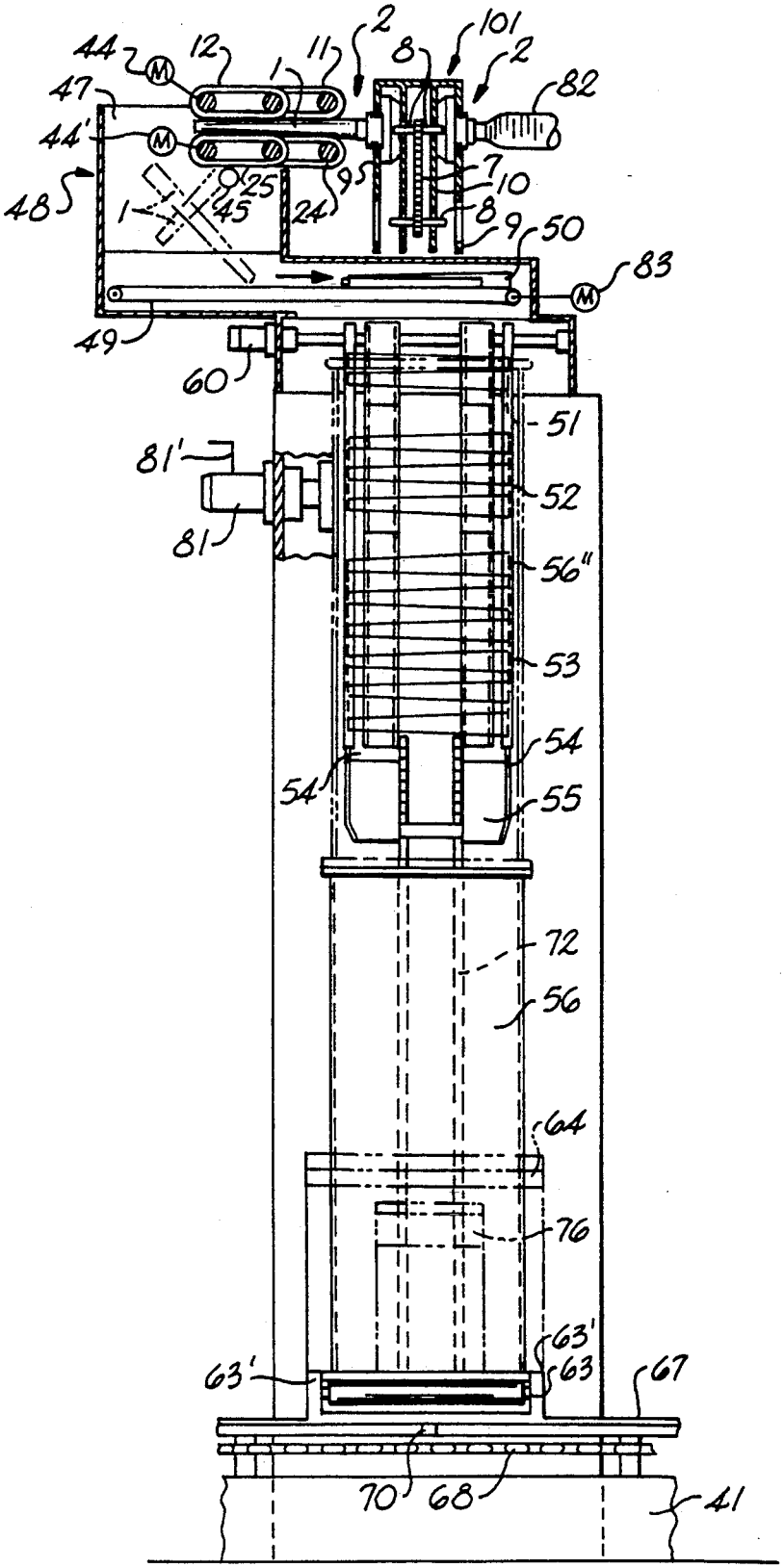
Figure 5:
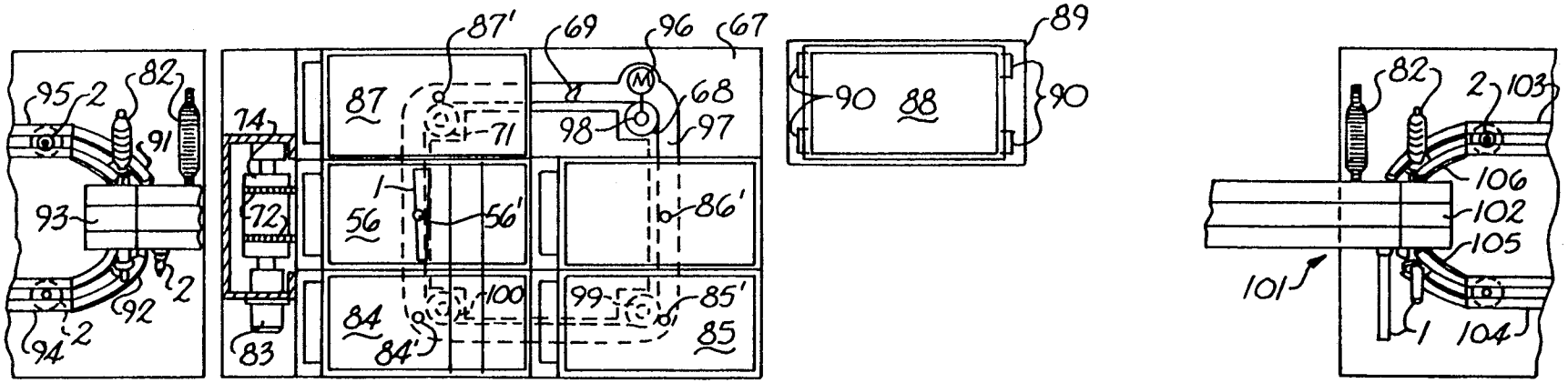
Figure 6:
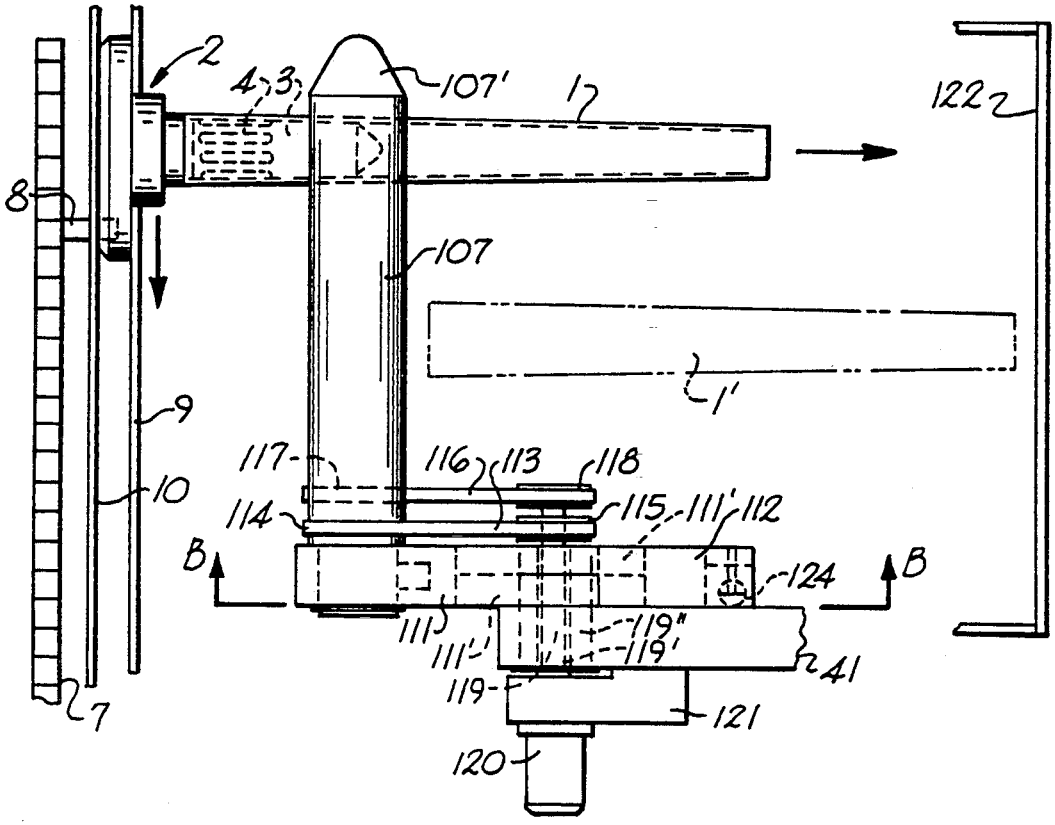
Figure 7:
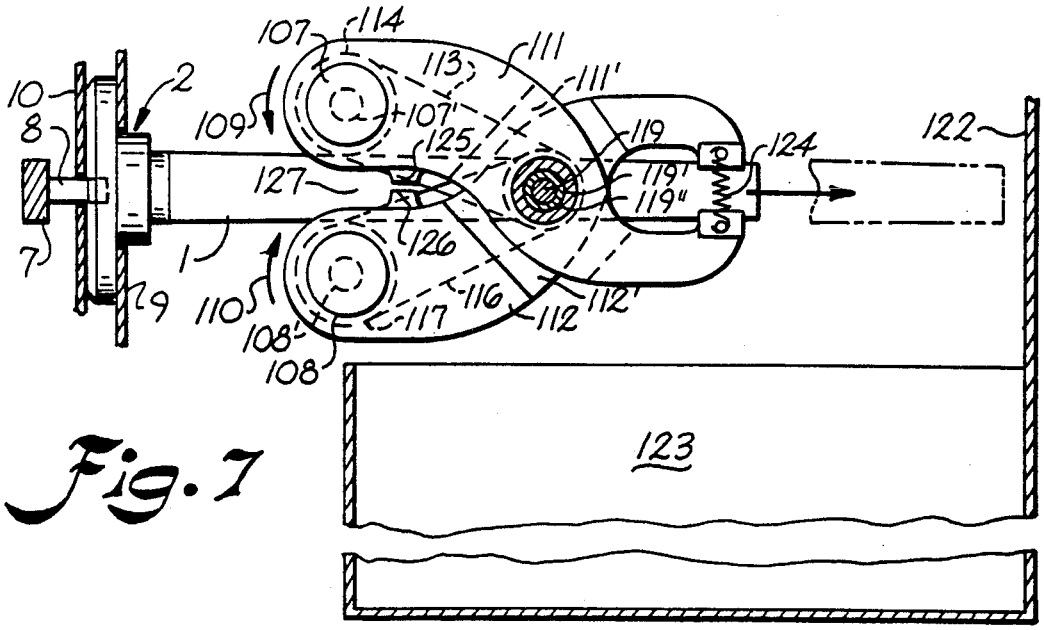
Figure 8:
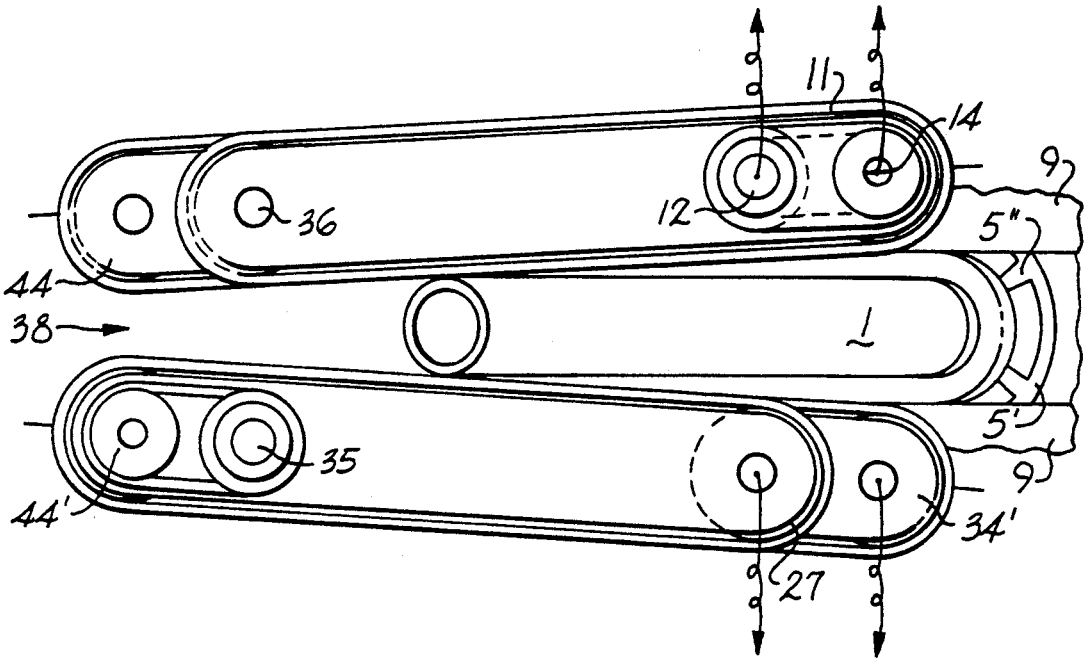

FIG. *3a* is an enlarged top plan view of the collection container transport means of the textile article removing apparatus shown in FIG. 3, showing an engagement catch thereof out of engagement with the engagement post of a collection container;

FIG. *3b* is an enlarged top plan view of the collection container transport means of the textile article removing apparatus shown in FIG. 3, showing an engagement catch in engagement with the engagement post of a collection container;

FIG. 4 is a side elevational view of the textile article removing apparatus shown in FIG. 3;

FIG. 5 is a top plan view of a portion of the textile article transport system of one textile machine and a portion of the textile article transport of another textile machine and showing the textile article collecting assembly of the textile article removing apparatus shown in FIG. 3 in its operative disposition between the two textile machines for collecting textile articles removed from support members;

FIG. 6 is an enlarged top plan view of a portion of another embodiment of the textile article removing apparatus of the present invention;

FIG. 7 is a side elevational view of the portion of the other embodiment of the textile article removing apparatus shown in FIG. 6; and FIG. 8 is an enlarged perspective view of an alternative embodiment of the textile article removing apparatus of the present invention.

DETAILED DESCRIPTION OF THE PREFERRED EMBODIMENTS

In FIGS. 1-5, one embodiment of the textile article removing apparatus of the present invention is illustrated. The textile article removing apparatus is operable to remove textile articles such as, for example, empty tubes 1 having no textile strand material thereon, from support members on which the textile articles are supported such as, for example, individual tube support members or caddies 2. Preferably, the textile article removing apparatus removes the tubes 1 from the caddies 2 during transport of the caddies 2 along an elevated horizontal portion of a bridge transport assembly 101 extending between a textile machine such as, for example, a textile winding machine (not shown) at which textile strand material built on the tubes 1 is drawn off of the tubes during a yarn winding process, and another textile machine such as, for example, a textile spinning machine (not shown) at which tubes having textile strand material built thereon are disposed onto empty ones of the caddies 2. The elevated horizontal portion of the bridge transport assembly 101 is typically at a spacing from the floor sufficient to permit the passage thereunder of textile machine operators, textile article transport devices, and the like.

Figure 1:
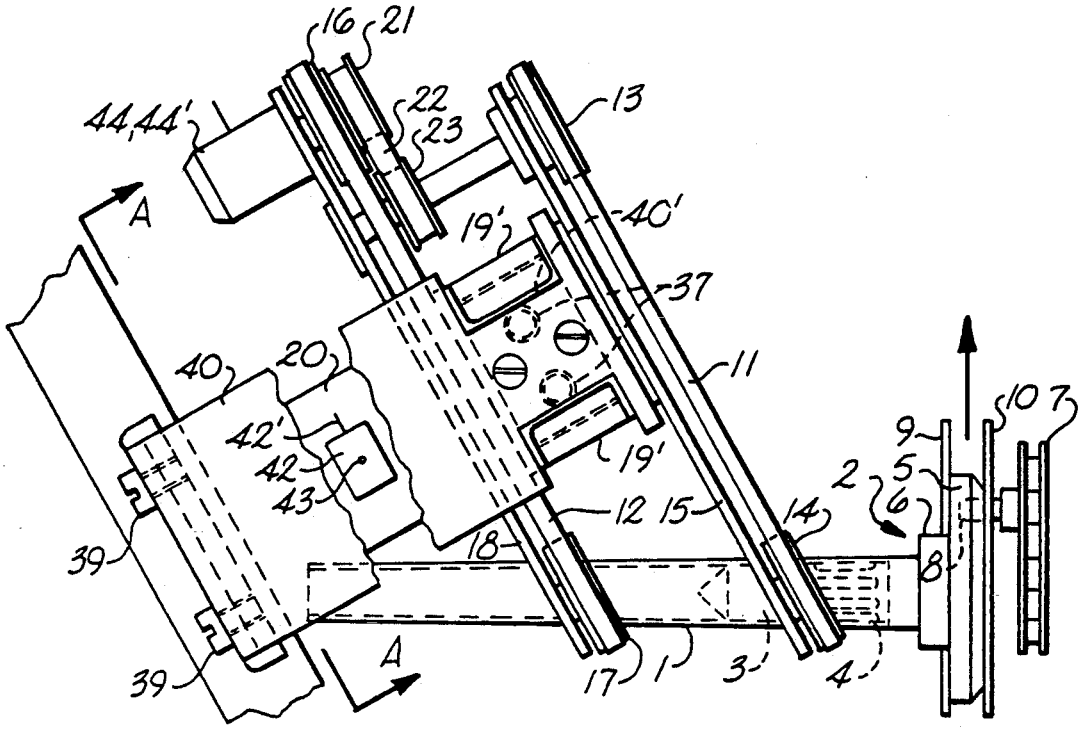
FIG. 1 is an enlarged top plan view of a portion of one embodiment of the textile article removing apparatus of the present invention.

The textile article removing apparatus removes the tubes 1 from the caddies 2 and collects the removed tubes 1 for recirculation of the collected tubes 1 within the interconnected transport system of the two textile machines interconnected by the bridge transport assembly 101. Each caddy 2, as seen in particular in FIGS. 1-3, includes an annular base portion 5', an annular neck portion of lesser diameter than the annular base portion 5' and coaxially mounted on the annular base portion 5' by a plurality of spokes 5'', and a post 3 of lesser diameter than the annular neck portion 6 and coaxially mounted thereto. As seen in FIG. 1, a spring 4 is mounted on each post 3 for resilient expansion against the inner annular surface of a tube 1 disposed on the post 3 to resiliently frictionally engage the tube 1.

Adjacent pairs of the spokes 5'' of each caddy 2 form an opening for the receipt therein of a respective one of a plurality of posts 8 mounted at uniform spacings along a flexible endless member 7 for advancing movement of the caddies 2 by the endless member 7. Each caddy 2 is maintained in supported relation on its associated post 8 by a pair of spaced, flexible guide members 9,10 extending parallel to the travel path of the caddies 2. The guide member 9 engages the top surface of the annular base portion 5' of each caddy 2 and the guide member 10 engages the bottom surface of the annular base portion to maintain the caddy 2 between the two guide members while the caddy 2 is advanced by the endless member 7.

Figure 2:
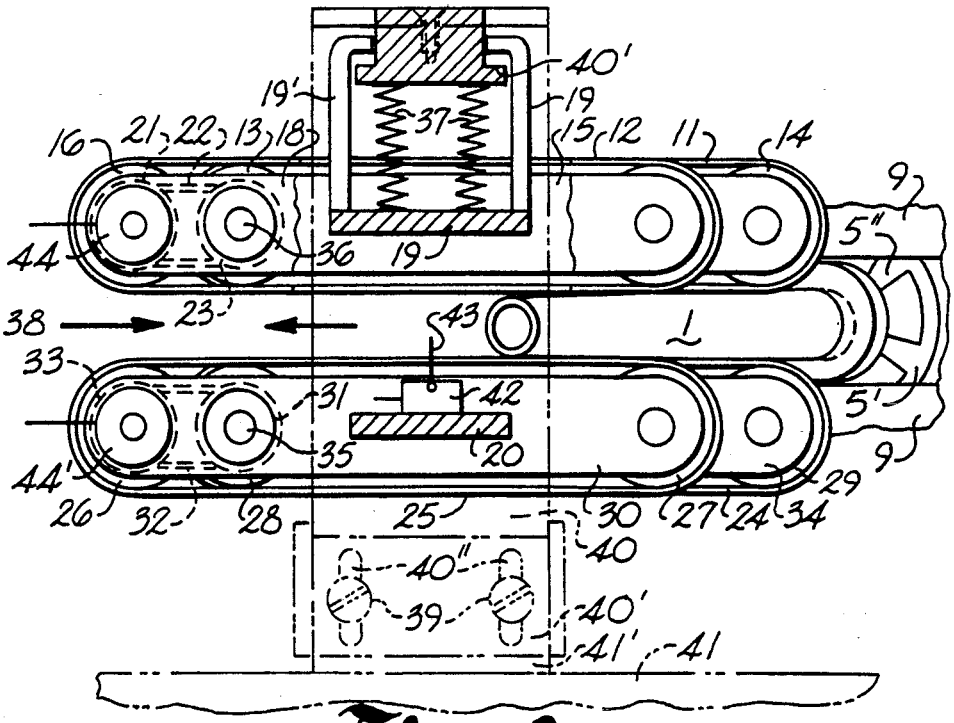
FIG. 2 is an enlarged perspective view of the portion of the textile article removing apparatus shown in FIG. 1.

The textile article removing apparatus includes means for displacing a textile article in a direction parallel to the axis of a post 3 on which the textile article is supported during advancing movement of the caddy 2 by the endless member 7 along the travel path to thereby effect movement of the textile article outwardly beyond the post 3 on which it is supported without inclination of the textile article or tube 1 relative to the post 3 sufficient to prevent removal. As seen in FIGS. 1-3, the displacing means includes a first pair of flexible endless members or belts 11,12 and a second pair of flexible endless members or belts 24,25, each pair of the belts 11,12 and 24,25 presenting opposed surfaces spaced from one another to form an elongate opening 38 therebetween.

The belts 11,12 and 24,25 are supported relative to the travel path of the caddies 2 such that the elongate opening 38 is aligned with a linear portion of the travel path. As seen in FIG. 1, the belt 11 is trained around a guide roller 14 rotatably mounted to one end of an arm 15 and is trained around a drive roller 13 rotatably supported on the other end of the arm 15. The belt 12 is trained around a guide roller 17 rotatably supported on one end of an arm 18 and around a drive roller 16 rotatably supported on the other end of the arm 18. A takeoff pulley 21 is coaxially mounted to the drive roller 16. A driven pulley 13 is mounted on a drive shaft 36 which is rotatably supported on the arm 18. The driven pulley 23 is fixedly mounted to the drive shaft 36. The drive roller 16 is mounted to the shaft of a drive motor 44. An endless drive belt 22 is trained around the takeoff pulley 21 and the driven pulley 23 for driving rotation of the driven pulley 23 in correspondence with the driving rotation of the takeoff pulley 21.

The drive motor 44 is operable to drivingly rotate the drive roller 16 and the coaxially mounted takeoff pulley 21 to thereby effect driving rotation of the drive pulley 13 in coordination with the driving rotation of the drive roller 16. By this coordinated driving arrangement, the belts 11,12 are driven at the same rate about their respective endless travel paths.

As seen in FIG. 2, the belt 24 is trained around a guide roller 29 rotatably mounted on one end of an arm 34 and around a drive roller 28 rotatably mounted to the other end of the arm 24. The belt 25 is trained around a guide roller 27 rotatably mounted on one end of an arm 30 and trained around a drive roller 26 rotatably mounted on the other end of the arm 30. A take off pulley 33 is coaxially mounted to the drive roller 26. The drive roller 28 is mounted to one end of a drive shaft 35 which is rotatably supported in the arm 30. A driven pulley 34 is coaxially fixedly mounted to the drive shaft 35 and a take off belt 32 is trained around the take off pulley 33 and the driven pulley 32 for driving rotation of the drive roller 28 in correspondence with driving rotation of the drive roller 26 by a drive motor 44' operatively connected thereto.

The arms 30,34 are each fixedly mounted to a support member 20, which is mounted to the support assembly 40, the arms 30,34 being mounted in spaced relation relative to the axis of a tube 1 being advanced along the travel path such that the belts 24,25 travel in parallel endless travel paths.

The arms 15,18 are mounted in spaced relation to one another on a bracket 19 with the belts 11,12 extending parallel to one another. As seen in FIGS. 1 and 2, the bracket 19 includes a base portion to which the arms 15,18 are mounted and a pair of legs 19' mounted to its base portion and extending perpendicularly therefrom. The free end of each leg 19' is formed with a flange extending transverse to the body portion of the leg and the flanged free end portions of the legs 19' form a spacing therebetween for the receipt therebetween of a flanged rail 40' of a support assembly 40. The support assembly 40 is adjustably fixedly mounted to a support plate 41' of a machine frame 41 by a plurality of bolts 39 each extending through a pair of elongate slots 40'' of the support assembly 40 and threadingly received in threaded bores of the support plate 41'. The flanged rail portion 40' includes an overhang portion integrally formed with a central portion extending centrally of the overhang portion and of lesser width than the overhang portion.

The flanged free end portions of the legs 19' receive the central portion of the flanged rail portion 40' therebetween and a pair of springs 37 extending between the overhang portion of the flanged rail portion 40' and the base portion of the bracket 19 resiliently bias the base portion of the bracket 19 outwardly away from the flanged rail portion 40'. Due to the overlapping relation between the flanged free end portions of the legs 19' and the overhanging portion of the flange rail 40', the bracket 19 is maintained in movably mounted relation on the flanged rail portion 40' with the springs 37 resiliently preventing movement of the base portion of the bracket 19 relatively toward the flanged rail portion 40'.

As seen in FIG. 2, the elongate slots 40'' of the support assembly 40 permit adjustable positioning of the belts 11,12 in a direction transverse to the travel path of the tubes 1. The limited movement mounting of the bracket 19 to the flange rail 40' permits resilient movement of the belts 11,12 in a direction transverse to the travel path of the tubes 1.

As seen especially in FIGS. 1 and 2, the support assembly 40 is mounted to the machine frame 41 at an orientation such that the parallel endless travel paths of the belts 11,12 and the belts 24,25 are in the plane of travel of the tubes 1 and at an inclination to the travel path. Additionally, the endless travel paths of the respective one belt of each pair of belts which is closer to the endless member 7 (e.g., the belts 11,24) are aligned with one another relative to the travel direction of the caddies 2 and the endless travel paths of the other respective belt of each pair of belts furthest from the endless member 7 (e.g., the belts 12,25) are aligned with one another relative to the travel path of the caddies 2. Moreover, the endless travel paths of the outermost belts 12,25 are offset from the endless travel paths of the other of the pair of belts 11,24, respectively, such that the forwardmost (e.g., upstream) travel of the two outermost belts 12,25 relative to the direction of travel of the caddies 2 is coincident with the forwardmost travel of the inner belts 11,24.

The width extent of the elongate opening 38 transverse to its elongate extent is preferably set at a value slightly less than the diameter of a tube 1. Adjustment of the width extent of the elongate opening 38 is accomplished through adjustable positioning of the bracket 19 via movement of the support assembly 40 relative to the machine frame 41. Since the springs 37 continuously bias the base portion of the bracket 19 outwardly away from the flanged rail portion 40', the width extent of the elongate opening 38 is enlarged upon entry of a tube 1 into the elongate opening as the bracket 19 compresses the springs 37 due to the laterally outward movements of the belts 11,12 in response to the entry of the relatively larger tube 1 into the elongate opening.

Alternatively, in lieu of the resilient movement arrangement provided by the springs 37, the rollers around which the belts 11,12 and 24,25 travel in their forwardmost travel (e.g., the guide rollers 14,17,29, and 27) can be resiliently movable relative to the drive rollers 13,16,26, and 28 such that the portion of the elongate opening 38 at which the tubes 1 initially enter the opening is resiliently expandable to an expanded width extent while the downstream end of the elongate opening 38 remains at a fixed, smaller width extent. In this alternative arrangement, the width extent of the elongate opening 38 would vary from its upstream entry end at which a tube 1 enters the elongate opening to its downstream end at which a tube 1 exits the elongate opening.

In another alternative arrangement in lieu of the springs 37 for resiliently biasing the belts 11,12 into their initial positions in which the width extent of the elongate opening 38 is slightly less than the diameter of a tube 1, the springs 37 are omitted and, instead, the combined weight of the belts 11,12 and their associated support components is appropriately selected so that the belts 11,12 are maintained under the force of gravity in their initial positions. As a further variation of this other alternative arrangement, appropriate supports can be provided on the bracket 19 for supporting thereon a weight supplements component such as, for example, a metal disk, which increases the combined weight of the belts 11,12 and their support components to a weight sufficient to maintain the belts in their initial positions.

The present invention also contemplates that the drive shafts 35,36 can be operatively connected to a common drive source via, for example, a pair of meshing gears, each mounted to a respective one of the drive shafts. In the event that such a common drive arrangement were to be provided, appropriate flexibility must be provided to accommodate the variations in the spacing between the drive shafts 35,36 resulting from changes in the position of the arm 15 relative to the arm 18.

The present invention additionally contemplates that a coordinated drive mechanism can be provided for coordinated operation of all the driven elements of the textile article removing apparatus. Preferably, an overall coordination mechanism would be operatively connected to the endless belt 7 for driving operation thereby, whereupon the need for a separate drive motor can be avoided. For example, a gear or pulley can be rotatably supported adjacent the endless belt 7 for driving rotation thereby.

As seen in FIGS. 1 and 2, a switch 42 is mounted to the support member 20 and includes a trigger 43 extending transversely into the elongate opening 38 generally at the midpoint of its longitudinal extent. The switch 42 is operatively connected via a connector 42' to a control unit (not shown). The trigger 43 is pivotally mounted on the switch 42 for pivoting movement in response to engagement thereof by a tube 1 being moved along the elongate slot 38.

To enhance to ability of the belts 11,12 and 24,25 to compressively engage and transport a tube 1 therebetween, a plurality of belt supporting components (not shown) can be secured to the arms 15,18 and 30,34 for supporting the belts along their runs forming the elongate opening 38. The belt supporting component would resist movement of the belts in a lateral direction transverse to the longitudinal extent of the elongate opening 38 to enhance the ability of the belts to compressively engage the tube 1 without slippage.

The operation of the belts 11,12 and 24,25 for removing the tubes 1 from the caddies 2 is as follows. The belts are supported on the machine frame 41 with the elongate opening 38 in an intercept position in which the tubes 1 being transported on the caddies 2 will enter the elongate opening 38 during their transport by the endless member 7. Although the present invention contemplates that the belts 11,12 and 24,25 can be positioned in an infinite number of positions for intercepting a textile article, for illustration purposes, it is seen in FIG. 3 that the tubes 1 are transported in orientations in which the tubes travel in a horizontal plane due to the fact that the caddies 2 are vertically suspended from the posts 8 during movement of the posts by the endless belt 7 along the elevated horizontal portion of the bridge assembly 101.

As seen in FIGS. 3 and 4, the textile article removing apparatus additionally includes a collection assembly for receiving the tubes 1 (or other textile articles) removed by the belts 11,12 and 24,25 and disposing the removed tubes 1 in space conserving manner for subsequent orderly removal of the empty tubes. An impact wall 47 extends transversely to the elongate opening 38 at a spacing downstream from the elongate opening relative to the transport direction of the caddies 2 and is offset laterally outwardly from the travel path of the endless belt 7 for interrupting the travel of the empty tubes 1 which have been transported beyond the elongate opening 38 by the belts 11,12 and 24,25. The impact wall 47 forms one wall of a routing chamber 48 for receiving the removed empty tubes 1 and routing the tubes to a stacking assembly at which the empty tubes are stacked in a predetermined manner for subsequent disposal in a mobile container. As seen in FIG. 4, an endless belt 49 disposed in the routing chamber 48 extends along an elongate bottom portion of the routing chamber 48. The endless belt 49 is trained around a drive roller which is operatively connected to a drive motor 83 for driving operation of the endless belt 49.

The routing chamber 48 has a generally L-cross-sectional shape with the impact wall 47 being in upright portion of the chamber and the elongate bottom portion along which the endless belt 49 extends forming the base portion of the routing chamber. A discharge wall 50 extends at an angle across the travel path of the endless belt 49 adjacent its downstream end for guiding empty tubes 1 being transported by the endless belt 49 outwardly beyond one lateral edge of the endless belt for subsequent downward movement of the empty tubes under the force of gravity into the stacking assembly.

As seen in FIG. 3, a hydraulic cylinder 45, which is operatively connected via the connector 42' to the switch 42, is operable to selectively extend or retract a piston 46 to effect tumbling of a tube 1 in response to a signal from the switch 42 indicating the travel therepast of an empty tube 1 being transported along the elongate opening 38.

As seen in particular in FIG. 4, the hydraulic cylinder 45 is mounted to the impact wall 47 at a location relative to the path along which the empty tubes 1 fall downwardly after their impact against the impact wall 47 for causing tumbling of a falling empty tube 1 as illustrated by the two broken line positions in FIG. 4. As a consequence of the translational movement of the empty tubes 1 along the elongate opening 38 during which the axis of the tubes remains parallel to the axis of the post 3 from which they have been removed, the empty tubes 1 exit the elongate opening 38 at its downstream end at an orientation in which the axis of the exiting empty tube is generally parallel to the impact wall 47. As a result, after impact with the impact wall 47, the empty tubes 1 fall downwardly in a plane parallel to the impact wall 47 and the hydraulic cylinder 45 is mounted on the impact wall at a location for extending its piston 46 outwardly into the downward travel path of the falling empty tubes 1 for engaging an empty tube at a location thereon offset from its center of gravity to effect tumbling of the empty tube. Additionally, the height of the hydraulic cylinder 45 above the travel path of the endless belt 49 is selected such that each empty tube engaged by the piston 46 tumbles in end-to-end manner such that it lands on the endless belt 49 in an oppositely turned orientation with respect to its initial orientation when the empty tube first begins to fall after impacting the impact wall 47. The control of the hydraulic cylinder 45 can be configured such that the cylinder extends its piston 46 upon the receipt of every second signal from the switch 42, whereupon every other empty tube 1 exiting the elongate opening 38 will be engaged by the piston 46. Since tubes for textile articles such as the tubes 1 are typically formed of a frustal-conical shape with one end thereof having a larger diameter than its other end, space can be conserved by stacking or piling such tubes with the large end of every other tube being in an opposite orientation to adjacent tubes.

The endless belt 49 transports the empty tubes 1 which have fallen thereon into guiding engagement with the discharge wall 50 for movement of the empty tubes laterally outwardly beyond the endless belt 49, as indicated by the arrow in FIG. 3. The empty tubes 1 fall downwardly into a stacking assembly comprising a pair of spaced, parallel vertical wall members 54 interconnected to one another along their lower ends centrally thereof by a gate piece 55. A plurality of pairs of movable floor members 51–53 are pivotally mounted to the machine frame 41 for pivotal moving within the spacing formed between the vertical wall members 54. Each movable floor member is pivotally mounted to the machine frame 41 and operatively connected to a motor 57–62, respectively, for pivotal movement of the movable floor member. The two movable floor members of each pair of movable floor members are selectively pivotable toward one another to form a closed-bottom textile article retaining region in which the empty tubes 1 are temporarily retained in stacked manner and pivotable away from one another to an opened-bottom configuration in which the empty tubes stacked therein fall freely downwardly below the movable floor members.

The first pair of movable floor members comprising the two floor members 51 is operable to form a closed-bottom region having the capacity for retaining two empty tubes 1 therein. The second pair of movable floor members comprising the two floor members 52 is configured such that the two floor members 51 of the first pair of movable floor members project interiorly therein and can move between their closed-bottom and opened-bottom configurations within the region formed between the two movable floor members 52. Moreover, the portion of the region formed by the two movable floor members 52 in their closed-bottom configuration below the first pair of movable floor members has sufficient capacity for receiving and retaining six stacked empty tubes 1.

The third pair of movable floor members comprising the two movable floor members 53 is configured such that the capacity of the region formed by the two movable floor members 53 in their closed-bottom configuration is sufficient for the second pair of movable floor members to project interiorly therein and to move between their closed-bottom and opened-bottom configurations. Additionally, the portion of the region formed by the movable floor members 53 below the second pair of movable floor members has sufficient capacity for receiving and retaining 24 of the empty tubes 1.

The vertical wall members 54 cooperate with the movable wall members 51–53 to retain the empty tubes 1 in stacked arrangements between the movable wall members.

The successive filling and unfilling of the pairs of the movable wall members with loads of the empty tubes 1 is coordinated with the positioning of an empty container 56 at a receipt location adjacent the stacking assembly for receiving the stacked empty tubes 1 unloaded therefrom. Each mobile container 56 is of a generally parallelopiped cross-sectional shape and has sufficient interior volume to permit the mobile container to be raised into a receipt position relative to the stacking assembly in which the vertical wall members 54 and the pairs of the movable wall members extend into the interior of the mobile container for unloading of the stacked empty tubes 1 retained by the pairs of the movable wall members in a manner described in more detail below.

As seen in FIG. 3, a plurality of sleds 63 are provided, each sled for individually supporting a mobile container 56 thereon. Each sled 63 includes a generally L-shaped platform on which a mobile container 56 is supported in upright disposition. A plurality of rollers 65 are mounted at uniform spacings along the base of the platform for rolling travel of the sled 63 along a track 67 which, as seen in FIG. 5, is preferably a closed loop track. A limit roller 66 is mounted adjacent the free end of the base portion of the sled platform for providing the dual function of a means for facilitating rolling travel of a mobile container 56 onto the sled and a means to prevent undesired slippage of a mobile container 56 from the sled onto which it has been loaded. As seen in FIGS. 3 and 4, the base portion of the sled platform is formed with a pair of spaced vertically extending flanges 63' for cooperating with the limit roller 66 to retain a mobile container 56 loaded onto the base portion of the sled platform.

As seen in FIGS. 3 and 5, an endless member or belt 68 is supported for travel about a plurality of guide rollers 71,99, and 100, and a drive roller 98, for displacing the sleds 63 along the track 67. A plurality of engagement catches 69, as seen in FIGS. 3, 3*a* and 3*b*, are mounted to the endless belt 68 at uniform spacings therealong for engaging an engagement pin projecting downwardly from each mobile container, such as a pin 56' of the mobile container 56, in a manner described in more detail below, to effect advancement of the mobile container and its associated sled along the track 67.

As seen in FIG. 3, an elevator component for raising a sled 63 from a lower position under the stacking assembly to a raised position, shown by the broken lines, in which the mobile container 56 on the sled 63 is in its receipt position for receiving the empty tubes 1, includes an endless member or belt 72 trained around a guide roller 73 and a drive roller 74. The drive roller 74 is operatively connected to a drive motor 81, as seen in FIG. 4, which is connected via a connector 81' to the control unit. An elevator retaining element 75 is mounted by a pair of mounting members 80 to the endless belt 72 and the elevator retaining component includes a catch member 76 having an upwardly sloped top surface and a side engaging member 78. The catch member 76 is adapted to engage a flange 64 extending from the sled 63. The flange 64 includes a downwardly sloped surface formed on its underside compatibly configured with the sloped top surface of the catch member 76 for engagement thereby. Additionally, each sled 63 includes a buffer member 77 mounted at a location for engagement by the side engagement 78 of the elevator retaining component 75 when the catch member 76 has engaged the flange 64 of the sled.

The operation of the stacking assembly to load the empty tubes 1 into a mobile container is as follows. Following the transfer of another mobile container which has just been filled with a complement of the empty tubes 1 away from the loading location, an empty mobile container supported on a sled 63 is delivered by the endless belt 68 into the lowered position underneath the stacking assembly. In correspondence with the delivery of the fresh empty mobile container, the drive motor 81 is controlled by the control unit to effect driving movement of the endless belt 72 of the elevator component to raise the elevator retaining component 75 from its preliminary position shown by the solid lines in FIG. 3 to an engagement position in which the catch member 76 engages the flange 64 of the sled 63 and the side engagement member 78 engages the buffer member 77 on the sled.

The endless belt continues its uninterrupted travel following engagement of the sled 63 by the elevator retaining component 75 to effect raising of the sled 63 to the broken line position shown in FIG. 3 in which the several pairs of the movable floor members 51–53 project interiorly into the mobile container. In correspondence with the arrival of the sled 63 in the raised position, the control unit stops the operation of the drive motor 81 and the endless belt 72 retains the sled 63 in the raised position.

The stopping of the driving operation of the drive motor 81 can be effected through, for example, a signal provided by a polarized material component positioned relative to the travel path of the sled 63 for cooperating with a Hall sensor component which counts the incremental travel of the endless belt 72.

With the mobile container in its raised position 56'', as shown by the broken lines in FIG. 4, the motors 59,60 operatively connected to the movable floor members 51 of the first pair of movable floor members are operated to move the two movable floor members to their closed-bottom retaining position. Thereafter, after the first two empty tubes removed from the caddies 2 are routed by the routing container 48 have dropped into the closed-bottom region formed by the two movable floor members 51, the motors 59,60 are operated to effect movement of the two movable floor members 51 to their opened-bottom release or unloading position. The operation of the motors 59,60 to effect this opening movement can be accomplished through, for example, an operative connection between the switch 42 and the motors 59,60 and a control unit which activates the motors after a time delay following the receipt of two signals from the switch 72 indicating that two empty tubes 1 have been removed from the caddies 2. Alternatively, a sensor such as, for example, a photoelectric beam emitting and sensing component, can be positioned adjacent the interface of the routing container 48 and the region formed by the two movable floor members 51, for sensing the travel therepast of an empty tube 1 falling into the region.

Prior to the movement of the movable floor members 51 to their opened-bottom release positions, the motors 58,61 operatively connected to the two movable floor members 52 of the second pair of the movable floor members effect pivoting of the movable floor members 52 to their closed-bottom retaining positions. Accordingly, as each pair of the empty tubes 1 previously retained in the first pair of movable floor members 51 fall therefrom, they are received and retained in the region formed by the two movable floor members 52.

With the receipt of a third pair of the empty tubes 1 in the region formed by the movable wall members 52, the movable wall members 52 reach their retaining capacity—e.g., the full capacity of six empty tubes—and the motors 58,61 pivot the movable wall members 52 outwardly away from one another to release the six empty tubes into the region formed by the two movable wall members 53, which have previously been moved to their closed-bottom retaining positions by the motors 57,62. The successive loading and unloading of the empty tubes 1 into the retaining regions formed by the movable wall members 51–53 continues until a full complement of 24 empty tubes 1 have been received in the retaining region formed by the movable wall members 53. In correspondence with the reaching of the full capacity of the third pair of the movable wall members, a selected one of the motors 57,62 is actuated to effect movement of the associated movable wall member 53 to an outward position 53' while the other movable wall member 53 remains in its retaining position.

As seen in FIG. 3, the channeling component 55 includes a pair of oppositely sloping surfaces each having a slope corresponding to the slope of a respective one of the movable wall members 53 to thereby form an extension thereof when the respective movable wall member remains in its retaining position during unloading. Accordingly, upon the movement of a selected one of the movable wall members 53 to its outward lateral position 53', the 24 empty tubes 1 retained by the movable wall members 53 are unloaded into the mobile container 56 supported at the raised position. The empty tubes 1 unloaded into the mobile container 56 are directed by the channeling component 55 to one respective side thereof.

The selected one of the movable wall members 53 which is moved to its outward lateral position 53' is alternated such that each complement of empty tubes 1 unloaded into the mobile container 56 is unloaded to on respective side of the channeling component 55. A counting device can be operatively connected to the motors 57,62 to ctivate each motor following a count of a total of eight unloading operations by the second pair of movable wall members 52. Following each counting operation, the counting device automatically resets itself to zero to count another eight unloading cycles of the second pair of the movable wall members 52.

The drive motor 81 is preferably controlled in coordination with the loading of the mobile container 56 to effect incremental lowering of the mobile container 56 in correspondence with its loading so that the free fall of the empty tubes 1 is minimized. Accordingly, the endless belt 72 is driven by the drive motor 81 to effect lowering of the sled 63 on which the mobile container 56 is supported in correspondence with the loaded condition of the mobile container. The rate of downward movement of the mobile container 56 is coordinated with the loading and unloading operations of the movable wall members 51–53 to minimize the extent to which the empty tubes 1 fall downwardly from the movable wall members 53 into the mobile container 56.

Through the cyclic loading and unloading of the movable wall members 51–53, the extent to which the empty tubes 1 freely fall as they are loaded into the mobile container 56 is optimally minimized, whereby, to the maximum extent possible, the empty tubes 1 remain in their alternating end-to-end stacked arrangement as they are deposited in the mobile containers 56. The present invention also contemplates that two pairs of the movable wall members 51–53 can be exclusively used with the primary consideration being to avoid a situation in which the empty tubes 1 lose their preferred stacked arrangement as they are successively transferred between the movable wall members to the mobile containers 56.

As seen in FIG. 5, the track 67 comprises a plurality of locations at which the sleds 63 are temporarily parked during the intermittent advancing operation by the endless belt 69. The number of parking locations for the sleds is one greater than the actual number of sleds being advanced along the track 67. For example, as seen in FIG. 5, a total of five sleds each individually support a mobile container 56 and 84–87 thereon and the track 67 comprises a total of six parking locations. At the end of each cycle of the intermittent advancing movement by the endless belt 68, one of the six parking locations is empty in readiness for receiving a new mobile container such as a mobile container 88 supported adjacent the empty parking location on a sled 89.

The mobile containers 84–87 each include an engagement member 84'–87', respectively, projecting downwardly from the sled platform for engagement by the engagement catch 69. Each of the engagement members 56' and 84'–87' projects downwardly through a slot 97 formed in the track 67 in alignment with the travel path of the endless belt 68 thereunder.

As seen in FIGS. 3*a* and 3*b*, the engagement catch 69 is pivotally mounted to the endless belt 68 and includes a concave portion having an arcuate curvature compatibly configured with the circumference of an engagement member of a mobile container. The engagement catch 69 also includes a flange 69' and a coil spring 70 mounted coaxially on the pivotal connection of the engagement catch 69 to the endless member 68.

The track 67 is preferably disposed at a location intermediate two textile article handling locations for receiving textile articles such as the empty tubes 1 during their transport between the two textile article handling locations. As seen in FIG. 5, the track 67 is disposed at a location intermediate the textile winding machine which unwinds yarn from a plurality of full yarn packages 82 supported on the caddies 2 and the textile spinning machine which builds textile strand material or yarn onto the empty tubes 1.

The bridge transport assembly 101 interconnects the textile winding machine and the textile spinning machine such that the caddies 2 travel in a closed loop between the two textile machines. After yarn is built on the empty tubes 1 to form the full packages 82 at the spinning stations (not shown) of the textile spinning machine, the full packages 82 are transported on the caddies 2 along a discharge transport assembly 95 to a transfer location 91 at which the caddies 2 are engaged by the post members 8 as they travel along a first vertical transport component 93 of the bridge transport assembly 101. The transfer of the caddies 2 at the transfer location 91 to the post members 8 occurs in convention manner as described, for example, in U.S. Pat. application Ser. No. 699,452, filed May 13, 1991, and further details of this conventional transfer operation are not provided herein.

The full yarn packages 82 extend horizontally as they are raised by the endless belt 7 along the first vertical transport component 93 and the full packages 82 are then transported horizontally along a horizontal transport component of the bridge transport assembly 101 forming its elevated horizontal portion and are subsequently lowered on a second vertical transport component 102 to a transfer location 106 at which the caddies 2 on which the full packages 82 are supported are transferred to a delivery transport assembly 103 of the textile winding machine. The delivery transport assembly 103 transports the caddies 2 with the full packages 82 thereon to a plurality of winding units (not shown) for unwinding of the yarn of the full packages 82 thereat.

As the yarn is fully unwound from each full package 82, only the empty tube 1 on which the yarn had been built remains on the caddy 2 and these empty tubes 1 are transported from the winding units by a discharge transport assembly 104 to a transfer location 105 at which the caddies 2 supporting the empty tubes 1 are engaged by the post members 8. The caddies 2 supporting the empty tubes 1 are then raised by the second vertical transport component 102 and subsequently horizontally transported along the horizontal transport component of the bridge transport assembly 101.

As the caddies 2 with the empty tubes 1 are horizontally transported, the empty tubes 1 successively enter the elongate opening 38 aligned with the horizontal travel path of the empty tubes and the empty tubes are removed from the caddies 2. As seen in FIG. 5, the sled 63 supporting the mobile container 56 receives the empty tubes 1 removed from the caddies 2. Following removal of the empty tubes 1 therefrom, the caddies 2, which are now empty, are further transported along the horizontal transport component and subsequently downwardly along the first vertical transport component 93 to a transfer location 92 at which the caddies 2 are transferred to a delivery transport assembly 94 of the textile spinning machine. The empty caddies 2 are further transported to locations adjacent the spinning stations of the textile spinning machine for receiving the full packages 82 thereon.

The catch and release operation of the engagement catch 69 is explained with reference to FIGS. 3*a* and 3*b*. As seen in FIG. 3*a*, when the endless belt 68 is moved in a reverse direction as indicated by the arrow, the engagement catch 69 is pivoted laterally inwardly as it is engaged by, and travels past, an engagement member such as, for example, the engagement member 56'. The coil spring 70, which normally biases the engagement catch 69 laterally outwardly, returns the engagement catch 69 to its normal laterally outwardly pivoted position as the engagement catch travels out of engagement with the engagement member. The flange 69' limits the extent of the laterally outward pivoting movement of the engagement catch 69.

In correspondence with the travel of the engagement catch 69 past the respective engagement member, the travel direction of the endless belt 68 is reversed from a reverse direction to a forward direction as shown by the arrow in FIG. 3*b*. Shortly after the forward travel of the endless belt has begun, the concave portion of the engagement catch 69 engages the respective engagement member to effect advancement of the respective sled and the mobile container supported thereon by the endless member 68.

The intermittent advancing operation of the mobile containers 56 and 84–87 will now be explained with reference to FIG. 5. In correspondence with the lowering of the filled mobile container 56 to its lowered position, the endless belt 68 is operated to sequentially advance the mobile containers 56 and 84–87 around the track 67. As seen in FIG. 5, a mobile container 88 fully loaded with a complement of the empty tubes 1 has previously been transferred from the track 67 onto the sled 89 for subsequent rolling transport of the sled 89 by its rollers 90 to a location at the textile spinning machine for transfer of the empty tubes 1 thereto. Consequently, one of the six parking locations of the track 67 is empty and the endless belt 68 is initially moved in a reverse direction by operation of the drive motor 96 to position the engagement catch 69 for engagement of the engage member 87' of the sled 87.

In correspondence with the advancement of the mobile container 87 by the endless belt 68 in the manner described above to the previously empty parking location of the track 67, the movement of the endless belt 68 is reversed from the forward direction to the reverse direction and the endless belt 68 is driven in the reverse direction until the engagement catch 69 has traveled past the engagement member 56' of the mobile container 56 at the empty tube loading location. The travel direction of the endless belt 68 is then reversed from the reverse direction to the forward direction to effect engagement of the engagement members 56' by the engagement catch 69 and corresponding advancing movement of the mobile container 56 along the track 67. The advancing movement of the mobile container 56 is stopped in correspondence with the arrival of the mobile container at the respective parking location on the track 67 previously occupied by the sled on which the mobile container 87 is supported.

The cyclic movement of the endless belt 68 in a reverse direction and then in a forward direction is continued to effect movement of the other mobile containers 84,85, and 86 into the parking locations previously occupied by the respective mobile container which had just previously occupied the parking location.

A respective sled from which a mobile container has just been unloaded onto the sled 89 is advanced during the intermittent advancing operation into the parking location occupied by the mobile container 86 as indicated in FIG. 5 and a new empty mobile container is supplied to the empty sled at that parking location.

The present invention also contemplates that mobile containers of relatively greater size than the mobile containers 56 and 84–87 can be used with equal effect. Also, the present invention contemplates that the repositioning of the mobile containers about the track 67 can be accomplished through an exchange of mobile containers between the sleds. Moreover, the present invention contemplates that an arrangement of only three sleds such as, for example, the sleds supporting the mobile containers 84,56, and 87, can be exclusively used to supply the loading position with fresh empty mobile containers. In this configuration, each full mobile container at the loading location can be transferred to the sled supporting the empty mobile container 87 and a fresh empty mobile container 84 can be transferred to the loading position.

To optimize the efficiency of the empty tube removing and stacking operation, it is advantageous to position a fresh empty mobile container in the loading position immediately after the transfer of the preceding full mobile container from the loading position. To this end, the reverse travel of the endless belt 68 can be controlled to ensure that the engagement catch 69 has already traveled rearwardly past the engagement member of the respective empty mobile container to be moved to the loading position prior to the completion of loading of the mobile container at the loading position. For example, the endless belt 68 is advantageously controlled to move the engagement catch 69 rearwardly past the engagement member 84' of the empty mobile container 84 prior to the completion of the loading of the mobile container 56 at the loading location. Thereafter, in correspondence with the completion of loading of the mobile container 56, the endless belt 68 can be controlled to travel in a forward direction, whereupon the empty mobile container 84 will be advanced into the loading position and will, simultaneously, push the full mobile container 56 beyond the loading position. In any event, the exchange of an empty mobile container for a full mobile container at the loading position must occur with the period of time during which the movable floor members 53 are loaded with a full complement of 24 empty tubes 1.

The drive motor 96 for driving operation of the endless belt 68 is preferably provided with a Hall sensor assembly for detecting incremental angular movement of the drive roller 98 about which the endless belt 68 is trained. This arrangement permits relatively exact determinations concerning the extent to which the endless belt 68 has traveled during its respective cyclic travels in the forward and reverse directions.

In FIGS. 6 and 7, another embodiment of the textile article removing apparatus of the present invention is illustrated. In this embodiment, in lieu of the belts 11,12 and 24–25 and their associated drive and support components, the textile article removing apparatus includes a pair of elongate rollers 107,108 rotatably supported in parallel, spaced relation to one another along their elongate extents to form an elongate opening 127 therebetween. The elongate rollers 107,108 are each rotatably supported at one end in a scissor arm 111,112, respectively, which are commonly pivotally mounted to the machine frame 41 via a hollow, pivot shaft 119' rotatably supported in a bushing 119'' in the machine frame 41. A rotation drive assembly 121 is mounted to the machine frame 41 and includes a drive motor 120 having a drive shaft 119 extending coaxially through the hollow interior of the common pivot shaft 119'. A pair of drive pulleys 115,118 are securely mounted in spaced, parallel relation to one another at the free end of the drive shaft 119.

A driven pulley 114 is secured to the elongate roller 107 and a drive belt 113 is trained around the driven pulley 114 and the drive pulley 115 for driving rotation of the elongate roller 107 in the direction indicated by the arrow 109 in FIG. 7. A driven pulley 117 is secured to the elongate roller 108 and a drive belt 116 is trained around the driven pulley 117 and the drive pulley 118 for driving rotation of the elongate roller 108 in the direction indicated by the arrow 110.

As seen in FIG. 7, each scissor arm 111,112 includes a stop flange 125,126, respectively, for engagement with the other stop flange to limit the pivotal movement of the elongate rollers 107,108 toward one another beyond a predetermined amount. Each scissor arm 111,112 includes a recess 111',112', respectively, for permitting pivotal movement of the other scissor arm relatively therealong. Each end of a coil spring 124 is mounted to a respective one of the scissor arms 111,112 for biasing the pair of scissor arms to pivot toward one another.

Each elongate roller 107,108 includes a tapering free end portion 107',108'. The tapering free end portions 107',108' form an entrance to the elongate opening 127 of greater width than the uniform width of the opening transverse to the elongate extent of the elongate opening 127.

The elongate rollers 107,108 are supported at a spacing from the endless belt 7 relative to the axis of the posts 3 and parallel to the travel path of the empty tubes 1 for intercepting engagement of the empty tubes 1 being transported by the endless belt 7. In the preliminary position of the scissor arms 107,108, the stop members 125,126 of the scissor arms are in engagement with one another and the width of the elongate opening 107 is slightly less than the diameter of an empty tube 1. As an empty tube 1 is transported into engagement with the tapering free end portions 107',108' during the transport of the empty tube 1 by the endless belt 7, the empty tube enters the elongate opening 127 and effects pivoting of the scissor arms 107,108 away from one another against the bias of the spring 124 due to the entry of the slightly larger diameter tube between the elongate rollers 107,108. In correspondence with the entry of an empty tube 1 into the elongate opening 127, the elongate rollers 107,108 are rotated in their respective opposite directions of rotation 109,110. Alternatively, the elongate rollers 107,108 can be continuously rotated.

The rotating elongate rollers 107,108 impart movement to the empty tube 1 compressively engaged therebetween in a direction parallel to the axis of the post 3 on which the empty tube is supported. The biasing force of the coil spring 124 is selected such that an empty tube 1 entering the elongate opening 127 can readily pivot the scissor arms 107,108 away from one another yet a sufficient compressive force is exerted on the empty tube 1 for the elongate rollers 107,108 to impart movement to the empty tube 1. Additionally, the biasing force of the coil spring 124 is selected to permit continued advancing movement of an empty tube 1 engaged by the elongate rollers 107,108 by the endless belt 7.

Accordingly, as each empty tube 1 enters the elongate opening 127, an axial force is imparted to the empty tube 1 to move the empty tube axially along and beyond the post 3 on which it is supported while the empty tube simultaneously continues in its advancing movement and travels along the elongate opening 127. As each empty tube 1 is moved completely axially beyond the post 3 on which it is supported, the empty tube 1 travels completely beyond the elongate opening 107, as indicated by the broken line position 1' in FIG. 6, and the empty tube continues to move until it contacts an impact wall 122 of a routing container 123. Thereafter, the removed empty tube 1 is routed by the routing container 123 to an empty tube collection assembly such as, for example, the collection assembly discussed with respect to the embodiment illustrated in FIGS. 1-5.

The present invention also contemplates that only one of the elongate rollers 107,108 is driven in its respective rotation direction while the other elongate roller is merely freely rotatable about its axis and is not driven. In another variation of the embodiment illustrated in FIGS. 6 and 7, a second pair of spaced, parallel elongate rollers can be provided in aligned relation with the elongate rollers 107,108 to yield a dual drive configuration similar to the dual drive configuration of the belts 11,12 and 24,25 of the embodiment of the textile article removing apparatus illustrated in FIGS. 1-5. In a similar vein, the two pairs of the elongate rollers can be inclined relative to the plane of travel of the endless belt 7 to provide, in addition to the axial movement component and the advancing movement component, an inclined movement component of the overall movement of an empty tube 1 being removed from the post 3 on which it is supported.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for removing textile articles from supported dispositions on support members, each textile article being a substantially rigid tube or a substantially rigid tube having textile strand material built thereon and each support member having a post for supporting a tube inserted thereon in co-axial relation thereto, the apparatus comprising:

means for advancing the support members and the textile articles supported thereon along a travel path;

means for displacing a textile article in a direction generally parallel to the axis of the post on which it is supported as the support member advances along the travel path to thereby effect removal of the textile article form the post readily without inclination of the textile article relative to the post during the removal of the textile article sufficient to resist removal, said displacing means including a pair of opposed article engaging surfaces forming an elongate opening therebetween and means for supporting said opposed article engaging surfaces with the elongate opening aligned with a portion of the travel path for entry of textile articles into the elongate opening during advancing movement of the support members along the travel path, the pair of opposed article engaging surfaces engaging each textile article advancing along the travel path and displacing it outwardly beyond its associated post as the post is advanced along the aligned portion of the travel path, said displacing means including a first movable member forming the at least one opposed article engaging surface and a second movable member forming the other opposed article engaging surface and means for synchronously moving the first and second movable members along a movement path which diverges at an acute angle from the travel path relative to the direction of advancing of the support members along the travel path such that the opposed article engaging surfaces compressively retain each textile article therebetween in a substantially non-twisting manner with the tube of the textile article remaining in co-axial relation to the support member as the article engaging surfaces are moved along the movement path at an ever widening spacing from the travel path, thereby removing the textile article from its associated post; and means for mounting at least one of the pair of opposed article engaging surfaces for resilient movement thereof in a direction transverse to the longitudinal extent of the elongate opening, the at least one opposed article engaging surface and the other opposed article engaging surface forming the elongate opening with a width extent transverse to the travel path slightly less than the corresponding width of the textile article which enters the elongate opening, the mounting means being operable to bias the at least one opposed engaging surface yieldably inwardly toward the other surface for compressive engagement of a textile article therebetween.

2. An apparatus for removing textile articles according to claim 1 and further comprising a third movable member forming an article engaging surface extending generally parallel to the article engaging surface of the first movable member and spaced therefrom relative to the axes of the posts, the means for synchronously moving being operable to move the third movable member along the movement path in synchronization with the first and second movable members and the article engaging surfaces of the first and third movable members being operable to engage each textile article at axially spaced locations thereon in opposition to the engagement of the textile article by the article engaging surface of the second movable member, whereby each textile article is compressively retained by the first, second, and third movable members as the members move divergingly away from the travel path.

3. An apparatus for removing textile articles according to claim 2 wherein each of the first, second, and third movable members have an entrance end at which the respective movable member initially engages a textile article entering the elongate opening and the entrance end of the first movable member is offset from the entrance end of the third movable member relative to the movement path such that the entrance ends of the first and third movable members initially engage a textile article entering the elongate opening at substantially the same time, whereby each textile article entering the elongate opening is retained by the first, second, and third movable members in substantially parallel orientation with the axis of the associated post as it is removed from the post.

4. An apparatus for removing textile articles according to claim 1 wherein the lateral spacing between the opposed article engaging surfaces at upstream ends relative to the direction of advancement of the support members is greater than the width of the articles to facilitate entry of textile articles into the elongate opening.

5. An apparatus for removing textile articles according to claim 4 wherein the pair of opposed article engaging surfaces form the elongate opening with a longitudinal extent greater than at least two times the corresponding width of a textile article.

6. An apparatus for removing textile articles according to claim 5 wherein each support member is independently movable and the means for advancing the support members includes an endless member and a plurality of engagement components mounted thereto, each engagement component individually engaging a support member for transport of the support member by the endless member.

7. An apparatus for removing textile articles from supported dispositions on support members, each textile article being a substantially rigid tube or a substantially rigid tube having textile strand material built thereon and each support member having a post for supporting a tube inserted thereon in co-axial relation thereto, the apparatus comprising:

means for advancing the support members and the textile articles supported thereon along a travel path including means for advancing the support members with their post axes in a horizontal plane and further comprising an assembly for arranging the removed textile articles in a predetermined arrangement following their removal from the posts of the support members including means forming a first retaining area for retaining a predetermined number of textile articles in a predetermined arrangement therein and means forming a second retaining area for retaining a predetermined number of textile articles therein in a predetermined arrangement, the second retaining area having a capacity to retain at least twice as many textile articles as the first retaining area, and the means forming the second retaining area being mounted relative to the means forming the first retaining area for receiving therefrom loads of textile articles; and means for displacing a textile article in a direction generally parallel to the axis of the post on which it is supported as the support member advances along the travel path to thereby effect removal of the textile article from the post readily without inclination of the textile article relative to the post during the removal of the textile article sufficient to resist removal, said displacing means including a pair of opposed article engaging surfaces forming an elongate opening therebetween and means for supporting said opposed article engaging surfaces with the elongate opening aligned with a portion of the travel path for entry of textile articles into the elongate opening during advancing movement of the support members along the travel path, the pair of opposed article engaging surfaces engaging each textile article advancing along the travel path and displacing it outwardly beyond its associated post as the post is advanced along the aligned portion of the travel path.

8. An apparatus for removing textile articles according to claim 7 wherein the displacing means is operable to translationally move each textile article in an orientation in which the axis of the tube of the textile article remains parallel to the post on which the textile article was supported after removal of the textile article from the post and the assembly for arranging removed textile articles in a predetermined arrangement includes means for selectively engaging a removed textile article to effect tumbling of the article in end-to-end manner.

9. An apparatus for removing textile articles according to claim 8 wherein each textile article is of a larger cross-sectional area at one end than at its other end and the means for selectively engaging a textile article to effect tumbling thereof is operable to effect tumbling of every other textile article removed by the textile article removing apparatus, whereby the removed textile articles can be arranged in end alternating manner by the assembly for arranging removed textile articles in a predetermined arrangement.

10. An apparatus for removing textile articles according to claim 7 wherein the means forming the second retaining area is disposed below the first retaining area for receiving loads of textile articles transferred therefrom and further comprising means for disposing a container in a loading disposition in which the means forming the first retaining area and the means forming the second retaining area project interiorly of the container.

11. An apparatus for removing textile articles according to claim 10 wherein the means for disposing a container for receipt of textile articles from the means forming first and second retaining areas includes means for lowering the container in correspondence with the loading of textile articles thereinto, the lowering means lowering a container after receipt therein of an initial load of textile articles dropped from the means forming the second retaining area at a spacing from the bottom of the container to a position in which the means forming the second retaining area is spaced further from the bottom of the container for facilitating the smooth transfer of textile articles from the means forming a second retaining area into the container.

12. An apparatus for removing textile articles according to claim 11 wherein the assembly for arranging removed textile articles in a predetermined arrangement includes a pair of spaced, generally parallel wall members centrally interconnected at their lower ends by a sloped channeling member, the sloped channeling member cooperating with the means forming a second retaining area to guide textile articles being transferred from the second retaining area into a container.

13. An apparatus for removing textile articles according to claim 11 and further comprising a container transport assembly for transporting containers into and out of a lowered position from which a container is raised into a loading position in which the means forming a second retaining area projects interiorly of the container.

* * * * *